US007765737B2

(12) United States Patent
Kain

(10) Patent No.: US 7,765,737 B2
(45) Date of Patent: Aug. 3, 2010

(54) GATE ASSEMBLY

(76) Inventor: David John Kain, P.O. Box 1257, Ingham, Queensland, 4850 (AU)

( * ) Notice: Subject to any disclaimer, the term of this patent is extended or adjusted under 35 U.S.C. 154(b) by 156 days.

(21) Appl. No.: 11/111,384

(22) Filed: Apr. 21, 2005

(65) Prior Publication Data

US 2005/0253127 A1 Nov. 17, 2005

(30) Foreign Application Priority Data

May 12, 2004 (AU) ..... 2004902486
Aug. 2, 2004 (AU) ..... 2004203497

(51) Int. Cl.
*E05C 7/06* (2006.01)

(52) U.S. Cl. ..... 49/95; 49/96

(58) Field of Classification Search ..... 256/1, 256/24, 73; 49/95, 96, 68; 292/44, 45, 54, 292/32, 33, 299, 68, 103, 104, 142, 394, 292/395; 403/321
See application file for complete search history.

(56) References Cited

U.S. PATENT DOCUMENTS 698,380 A * 4/1902 Francke ..... 49/68
1,184,725 A * 5/1916 Dawes ..... 49/68
1,504,795 A * 8/1924 Trost ..... 49/63
1,632,683 A * 6/1927 Tracy ..... 49/68
1,685,998 A * 10/1928 Hagstrom
1,756,718 A * 4/1930 Wild ..... 292/DIG. 21
2,543,643 A * 2/1951 Ryan et. al. ..... 312/218
2,926,012 A * 2/1960 James ..... 49/68
3,174,193 A * 3/1965 Smith ..... 49/68
3,564,132 A * 2/1971 Baker et al. ..... 340/5.7
3,826,520 A * 7/1974 Ross et al. ..... 49/68
5,553,833 A * 9/1996 Bohen ..... 256/24
5,687,507 A * 11/1997 Beran ..... 49/340
5,944,397 A * 8/1999 Zeitler ..... 312/220
6,484,650 B1 * 11/2002 Stomski ..... 109/6

FOREIGN PATENT DOCUMENTS

FR 2596900 10/1987
GB 1419382 A * 12/1975

* cited by examiner

*Primary Examiner*—Victor MacArthur
(74) *Attorney, Agent, or Firm*—Renner, Otto, Boisselle & Sklar, LLP

(57) ABSTRACT

A gate assembly comprising an enclosure, the enclosure being accessible by a first gate and a second gate, and gate operating means, wherein unlatching of the first gate causes the second gate to remain latched, and the second gate cannot be unlatched until the first gate is latched.

12 Claims, 9 Drawing Sheets

FIG H

GATE ASSEMBLY

FIELD OF THE INVENTION

This invention is directed to a gate assembly, and is particularly directed to a gate assembly that prevents inadvertent entry into an area. The invention finds particular use to prevent inadvertent entry into a swimming pool enclosure or other type of restricted or dangerous area, although no limitation is meant thereby, and the invention may also have application in other areas where it is desirable to have a "safety" gate access system.

BACKGROUND ART

Drowning is the single most common cause of death of toddlers aged 1 to 4 years in Australia; about half of these deaths occur in residential swimming pools or spas. For every drowning, there are many more near-drownings. Of those children hospitalised for near-drowning, 5-20% will suffer some brain damage. Tragically, in 2002, 35 children drowned in swimming pools.

In most parts of Australia, it is now mandatory to provide a pool fence around the swimming pool. It is also mandatory to have a self-closing gate which is fitted with a childproof latch. However, these gates can be left open from a number of causes such as by accident, by being propped open, by being tied open, and sometimes the latch fails to properly close the gate. These gates have some form of spring mechanism to naturally close the gate. It is also possible for the spring mechanism to become worn thereby causing the gate to close but not latch, or to only partially close. A fairly common cause for malfunction of the gate is due to misalignment of the latch with the keeper. This can happen by improper assembly but also due to sagging of the hinges which can happen if the child swings on the gate door. If the swimming pool gate does not work properly, there is no barrier to a child passing into the swimming pool enclosure.

Although it is envisaged that the gate assembly will have an important use with swimming pool enclosures, the invention is not to be limited only to this use. For instance, the gate assembly can be used to prevent inadvertent or unauthorised entry into various restricted or dangerous areas such as roadways, dangerous goods areas, child care play areas and the like. It is also envisaged that the gate assembly can function not so much to prevent inadvertent entry into a restricted area but to prevent inadvertent exit from a restricted area. For instance, the gate assembly could be used in an aviary or other type of animal enclosure to allow people to enter and exit the animal enclosure with reduced likelihood of the animals able to escape. Therefore, there would be an advantage if it were possible to provide a gate assembly which did not rely on a single gate to provide entry or exit from a particular area, or which would provide a useful or commercial choice to the consumer. It will be clearly understood that, if a prior art publication is referred to herein, this reference does not constitute an admission that the publication forms part of the common general knowledge in the art in Australia or in any other country.

Object of the Invention

It is an object of the invention to provide a gate assembly that may overcome at least some of the above-mentioned disadvantages or provide a useful or commercial choice.

In one form, the invention resides in a gate assembly, the gate assembly comprising an enclosure, the enclosure being accessible by a first gate and a second gate, and gate operating means, wherein unlatching of the first gate causes the second gate to remain latched, and the second gate cannot be unlatched until the first gate is latched.

In a broader form, the invention resides in a gate assembly that can operate at least two gates in such a manner to improve safety.

In this manner, there is no possibility of the child being able to pass through a single malfunctioning gate. If one gate is unlatched, the second gate must be latched and vice versa.

Suitably, the size of the enclosure is sufficient to allow at least one person to be within the enclosure in a relatively comfortable manner. Therefore, the enclosure may have an internal area of between 1-5 square metres and preferably about 1.5-2.5 square metres.

The enclosure can be made from any suitable material such as fencing, although no limitation should be placed on the invention merely by the material from which the enclosure is made. If the enclosure is for use in a swimming pool, it is preferred that the enclosure meets the requirements of pool fencing with respect to height, and spacing between the fence railings etc. Of course, if the enclosure is for other uses, this need not be necessary.

The shape of the enclosure may vary although the enclosure should have a shape to allow proper operation of the gates. For instance, the enclosure may have an oval shape, a circular shape, a rectangular shape, a triangular shape, a polygonal shape, or an irregular shape.

The gate assembly may comprise a centre post frame. The centre post frame may comprise a plurality of vertical support posts. Suitably, the centre support frame comprises a central support post and an adjacent support post on each side of the central support post such that the centre post frame comprises three support posts.

The centre support post may contain part or all of the gate latch mechanism.

Each adjacent support post may support a gate, and typically the gate will be hingedly attached to or relative to the adjacent support post. If the gate is a self-closing gate (which is preferred), some form of spring member and the like may be provided to bias the gate to the closed position. A special type of non sagging hinge may be provided.

Each gate can open inwardly or outwardly relative, and the swing of the gate may de determined by regulations. For instance, for a pool gate it is a requirement that the gate opens outwardly from the pool enclosure.

The gate operating means will typically comprise a locking mechanism. Suitably, the locking mechanism comprises at least one locking plate attached to each gate such that movement of the gate causes movement of the locking plate. The locking plate preferably comprises a semi circular periphery. A slot may be provided in the semi circular periphery.

The gate operating means typically additionally comprises a lock box. The lock box may be fitted to the centre post frame. The lock box may be provided with a recess into which part of the locking plate on a particular gate can pass. Therefore, if a pair of gates is provided, it is preferred that the lock box is provided with a pair of recesses. Typically, the arrangement of the lock box and the locking plate is such that the locking plate is always in the recess of the lock box even when the gate moves from a closed position to an open position.

The gate operating means typically additionally comprises a locking means or a locking member. The locking member may comprise a sliding locking bar. The sliding locking bar can slide or reciprocate between a first position where the locking bar locks one gate and a second position where the locking bar locks the other gate. It is preferred that the arrangement of the locking members is such that when one gate is unlocked, the other gate must be locked and vice versa.

In a simple form, the locking bar can move into the slot in the recess of the locking plate. Therefore, to operate a particular gate, it is necessary to move the locking member out of engagement in the slot before the gate can be opened.

It should of course be appreciated that no particular limitation is to be placed on the precise operation of the gate operating means merely by the description of a preferred embodiment of the invention.

BRIEF DESCRIPTION OF THE DRAWINGS

An embodiment of the invention will be described with reference to the following illustrations in which.

DETAILED DESCRIPTION

Overview of the Apparatus

Figure 1:
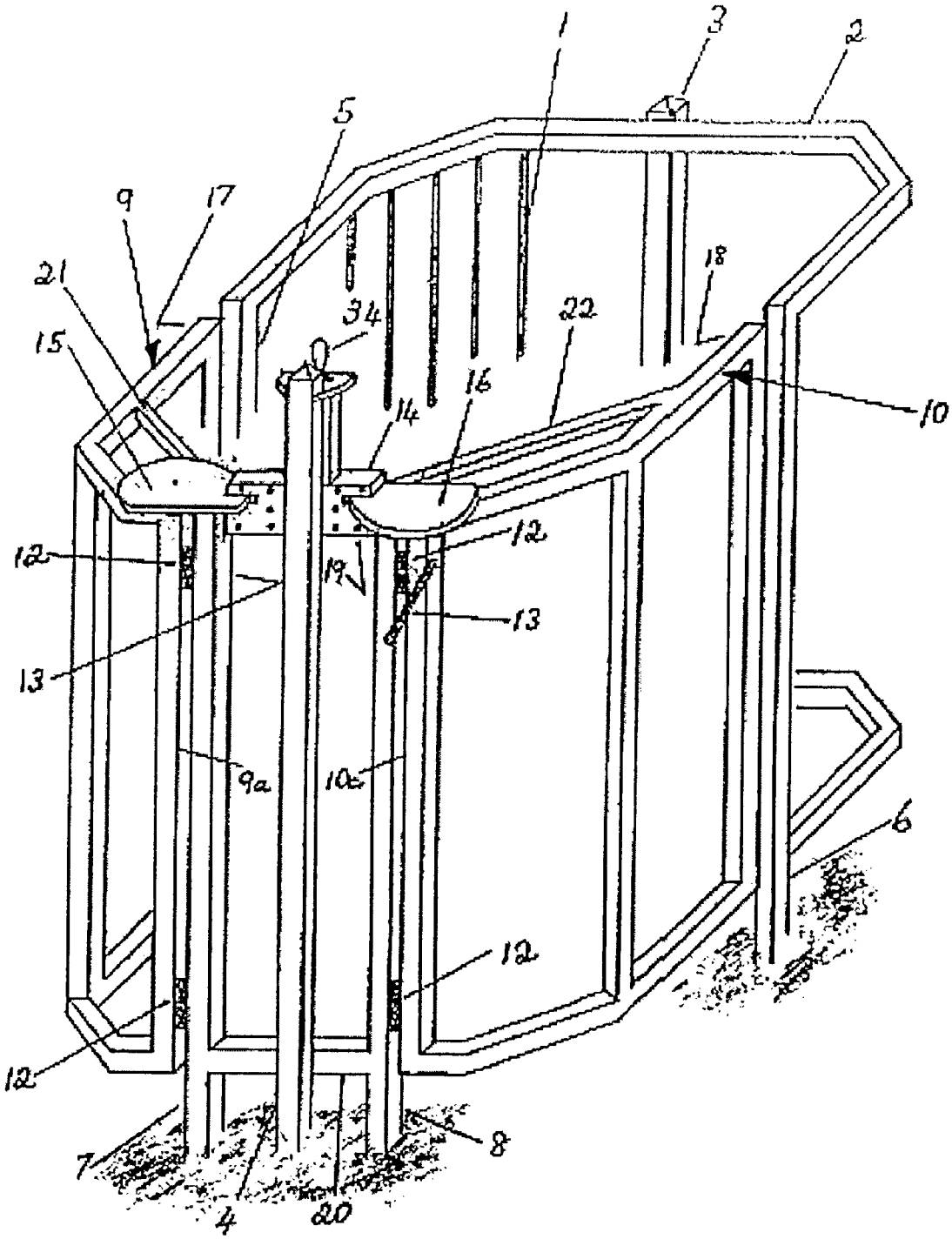
FIG. 1. Illustrates a gate assembly according to an embodiment of the invention.

The apparatus illustrated in FIG. 1 is typically constructed, at a minimum, to the same specifications as other swimming pool fencing which complies with the current standards and regulations as prescribed by the local, state or Australian government bodies. This includes the barring on the fencing panels FIG. 1 item 1, as well as the metal box section material FIG. 1 item 2 used in the fabrication of the main frames. In most cases, some aspects of the apparatus structure would be constructed of a stronger or more rigidly designed material with additional brackets or gussets to those as prescribed by law under the swimming pool fencing standards or regulations.

The size of the apparatus would be approximately 1.5 metres in length, approximately 1.0 meter in width and at least 1.2 metres in height. However, the size can be altered and manufactured to suit its intended use, depending whether it be for a private or commercial application.

The apparatus can be incorporated into a barrier fence restricted area in a number of positions and configurations depending on the availability of space in the particular application.

The operating handle FIG. 1 item 34 is situated at a prescribed height to be out of the reach of small children.

The support posts FIG. 1—item 3, 4, 5, 6, 7, & 8, will usually be concreted in place, culminating in the formation of a small base stab providing rigidity and strength to the structure. The two centre support posts FIG. 1—item 3 & 4 and FIG. 2 item—3 & 4 are the sectors of the apparatus which provide the connection points on the frame for the adjoining barrier fencing FIG. 2—item 30 of the main restricted entry enclosure area, e.g. A swimming pool enclosure (see FIG. 2).

The centre post frame incorporates three of the support posts FIG. 1—item 7, 4 & 8 connected by the top and bottom cross bars FIG. 1—item 19 & 20. Adjacent to this centre post frame and sited opposite to each other on the apparatus structure, are the dual gates. These two separate gates FIG. 1—item 9 & 10 and FIG. 2—item 9 & 10 are individually and independently operated, one being a 'left-hand gate' FIG. 1—item and FIG. 2—item 9, and the other a 'right-hand gate' FIG. 1—item 10 and FIG. 2—item 10. The left hand gate, being the one facing the swimming pool, opens inwards into the apparatus enclosure whilst the right hand gate opens outwards from the enclosure. Due to the special apparatus locking mechanism only one gate can be opened at a time, is it being an 'alternate opening and alternate locking' dual gates system.

Each of the two gates FIG. 1—item 9 & 10 swing on specially constructed non-sagging hinges FIG. 1—item 12. The hinges are attached to the 'centre post frame' support posts FIG. 1—item 7 & 8 for gates FIG. 1—item 9 & 10 respectively. The gates are spring loaded FIG. 1—item 13 on the 'centre post frame' support posts FIG. 1—item 7 & 8 to return to the closed position up against the gate stops FIG. 1—item 17 & 18 on the support posts FIG. 1—item 5 & 6 respectively. These gate stops FIG. 1—item 17 & 18 which are almost the full gate height, are simply thin, flat section steel backing plates welded to the uprights being support posts FIG. 1—item 5 & 6, beside which each gate closes. As a two-fold feature, these gate stops also inhibit the small toes and hands of young children from gaining a hold in the small crack between the front edge of the gate frames and the upright support posts.

Flat section steel backing plates of a similar length, shape and size as those used for the gate stops, are welded to the inside i.e. being on the inside of the apparatus enclosure and outside edges of the support posts FIG. 1—item 7 & 8 to which the hinges for the gates are attached. These flat section steel backing plates are installed, one on either side of these support posts FIG. 1—item 7 & 8, and cover the crack between the hinge support post FIG. 1 7 & 8 and the gate frame hinged uprights on the gates FIG. 1—item 9 & 10. These fixtures also act as a deterrent against young children's hands and feet gaining a hold for climbing.

The Apparatus Locking Mechanism

Figure 8:
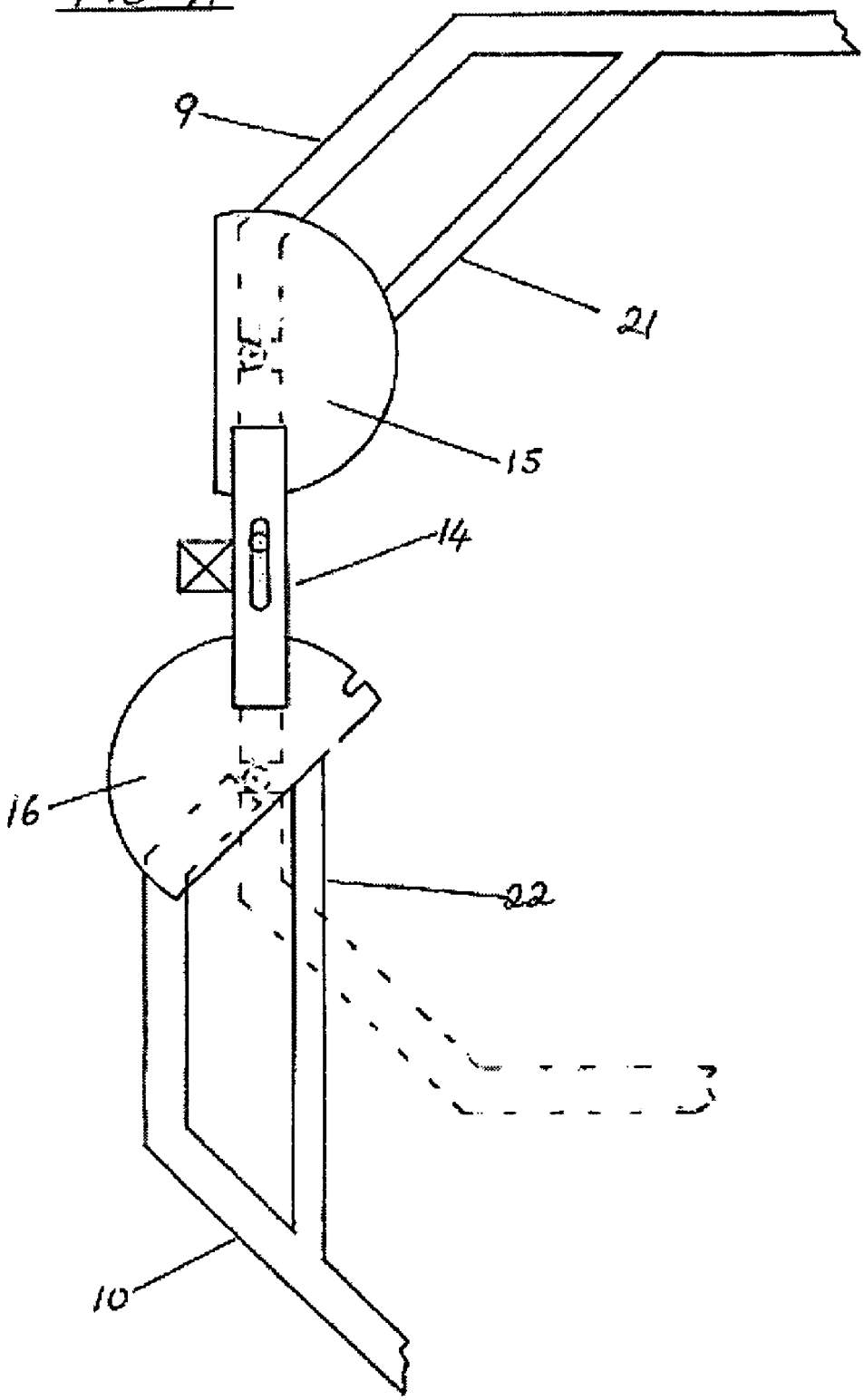
FIG. 8. Illustrates a plan view of the latching mechanism.

The locking mechanism, FIG. 8—item 14, 15 & 16, is a manually operated 'positive locking' arrangement. There are no automated components or moving parts incorporating rods, levers, magnets, springs, pivoting mechanisms, electrical installations, battery mechanisms, switches, keys, etc., any of which could let the system down inadvertently. A simple, slight horizontal movement by hand of the operating handle, either to the left or to the right, completes the whole locking cycle. FIG. 8 shows the positioning of the lock box 14, the locking plates 15 and 16 which are mounted on the two gates FIG. 8—item 9 & 10 respectively.

Explanation of the Locking Mechanism Components

The locking mechanism for the apparatus consists of two 2 parts:

1. The lock box FIGS. 3 & 4, FIG. 1—item 14, and
2. The locking plates FIG. 9, FIG. 1—item 15 & 16 and FIG. 8—15 & 16

1. The Lock Box

Briefly, the lock box FIG. 1—item 14 is positioned on the centre post frame which as previously described incorporates support posts FIG. 1—item 7, 4 & 8 and the top and bottom cross bars FIG. 1—item 19 & 20 of the apparatus frame and is fixed by bolts on to the top cross bar FIG. 1—item 19—which is hidden by the lock box. The lock box is more clearly described below.

2. The Locking Plates

Each of the two 2 locking plates FIG. 1—item 15 & 16 FIG. 8—item 15 & 16 is a semi-circular metal plate which is permanently secured or welded onto the top of the hinged end of each gate FIG. 1—item 9 & 10 FIG. 8—item 9 & 10. The centre point of this semi-circular locking plate coincides exactly with the centre point of the swivel action of the hinge positioned below. The outer edge of the semi-circular locking plate cuts an arc which mimics exactly an imaginary corresponding arc cut by the centre point of the hinge swivel action.

The locking plate on the right hand gate moves through its arc in the opposite direction than the locking plate on the left hand gate. This is because one gate opens into the enclosure while the other opens outward away from the enclosure as described earlier.

Figure 3:
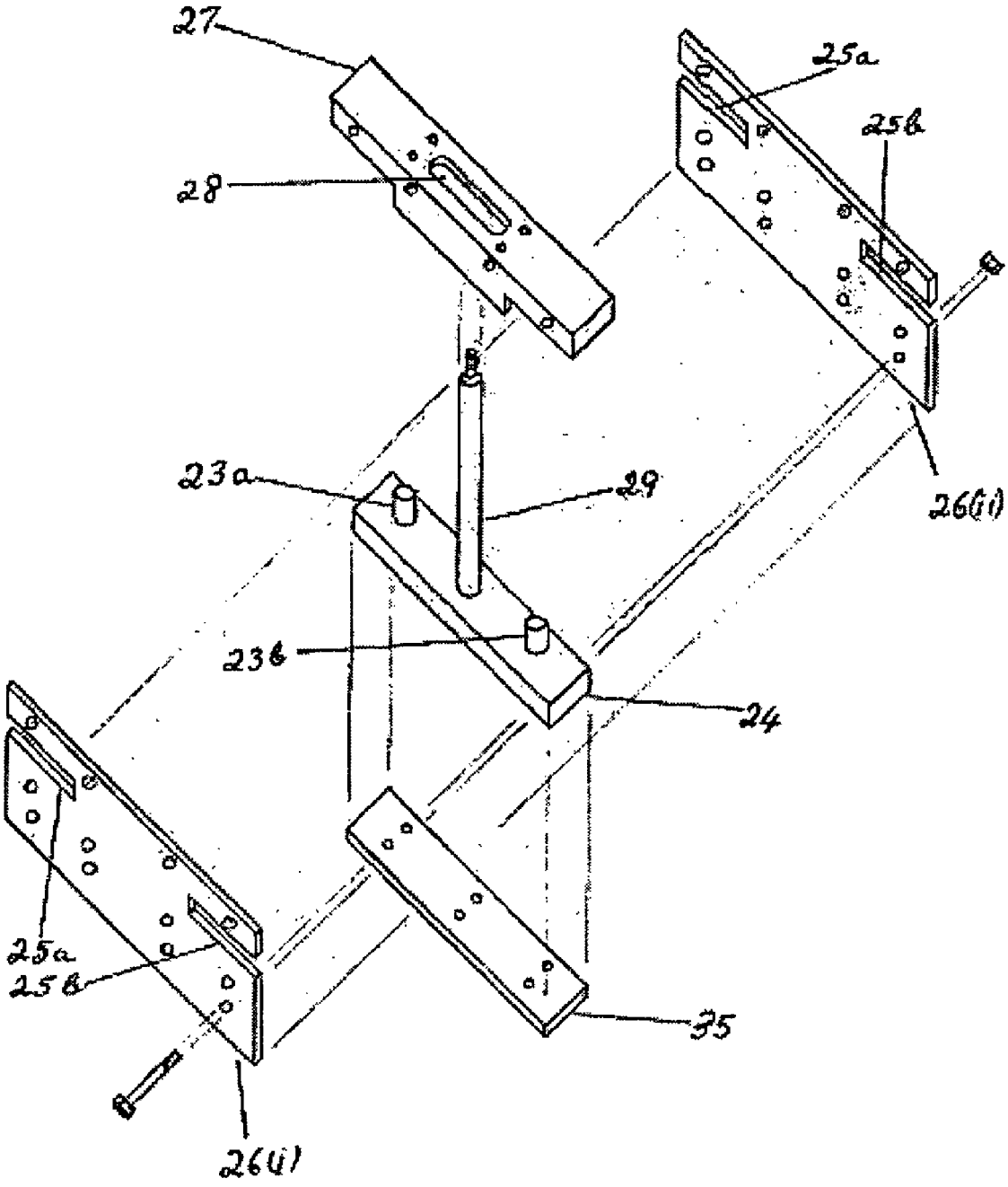
FIG. 3. Illustrates an exploded view of the lock box.
Figure 9:
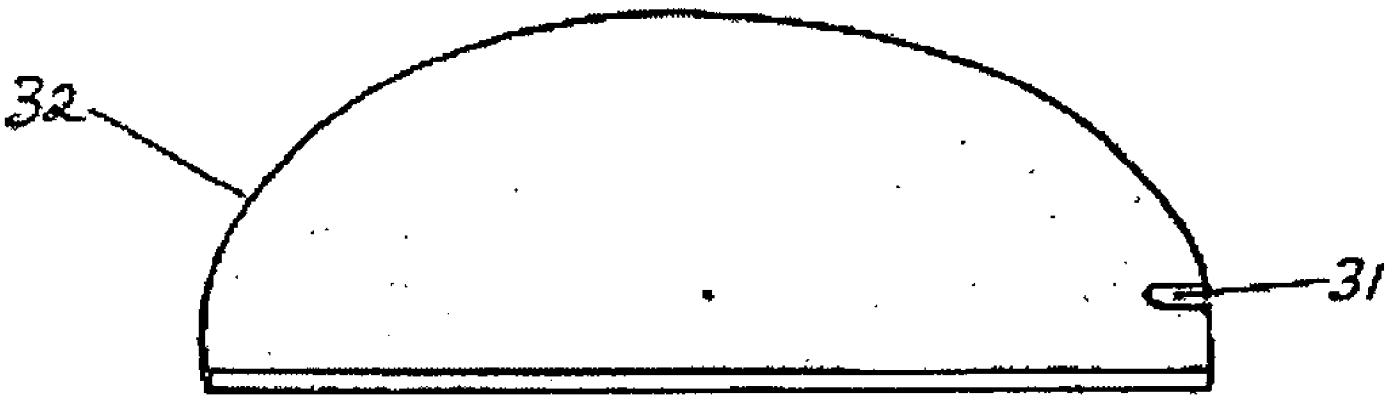
FIG. 9. Illustrates a plan view of the locking plate.

Each locking plate, of which there are two as previously stated, is a fabricated piece of flat galvanised steel approximately 280 mm in diameter and approximately 8 mm thick, fashioned into the shape shown FIG. 9 with a small 'elongated c' shaped cut-out FIG. 9—item 31 sized to accommodate a slightly smaller round locking pin FIG. 3—item 23*a* & *b*. The edge FIG. 9—item 32 of the locking plate is instrumental in the locking mechanism of the apparatus as it prevents movement of the sliding locking bar FIG. 3—item 24 in the various sequences of the lock box operation FIGS. 5 and 6—diagrams i to v. The opening and closing of the gates creates the movement of the locking plates FIG. 8—15 & 16 as an arc as previously mentioned which passes through the specially formed slots FIG. 3—item 25*a* & *b* machined in the sides of the lock box FIG. 3. The lock box is detailed further in a later section.

A support bar FIG. 8—21 & 22 connects between the locking plate and the top rail of the gate frame. This acts as a 'direct in-line stabiliser support from the actual locking pin FIG. 3 item 23*a* & *b* component of the lock box to the opposite front closing edge of the gate structure.

The 'Lock-Box' of the Apparatus

Figure 4:
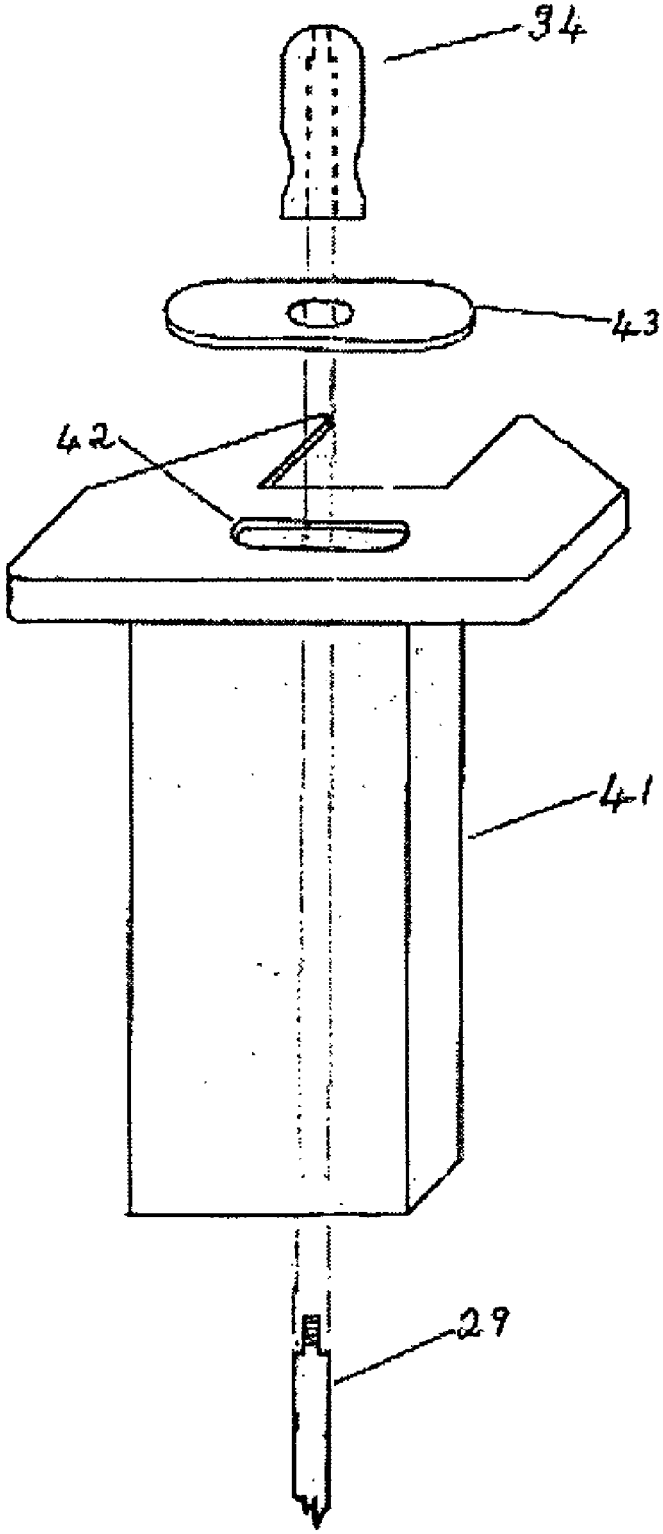
FIG. 4. Illustrates an exploded view of part of the latching mechanism.

The lock box assembly FIGS. 3 & 4 and FIG. 1—item 14 is fabricated from stainless steel to give optimum life expectancy with trouble free and corrosion free performance in its operation whilst requiring minimal maintenance.

The high quality stainless steel material, coupled with very sturdily machined parts incorporated into its assembly, is designed to be a priority safety component of the apparatus. The key working elements have been designed to exclude materials such as plastics which become brittle in the sun; alloys which break down with age and weather; and ordinary steel which rusts.

With a normal gate concept where the hinges and locks are located at opposite sides of the gate structure, even if small degrees of wear develop in the hinges, the natural characteristics of distances magnifies the misalignment at the other extremity being the latching point. Any such wear can be responsible for the failure of the latching mechanism allowing the access restriction, i.e. the gate, to fail. However, with the lock box, locking plate and hinge structure of the apparatus even if undue wear under extraordinary circumstances were to occur, the locking components would remain serviceable due to its particular construction and therefore safety would not be compromised.

The lock box has also been designed to allow it to be fully opened at the top if necessary, thus exposing the internal workings for inspection, servicing or cleaning, whilst once again, the locking component would still remain safe, ensuring the integrity of the apparatus as a safety access monitoring device.

The positioning of the lock box FIG. 1—item 14 in relation to the design of the enclosure allows for easy manoeuvring of the actuator or operating handle by a responsible person. The positioning of the operating handle is located on the top of an extended section of the lock box FIG. 4—item 41 to ensure compliance of prescribed height regulations. This extended section which is secured by screws or fasteners to the upright centre post FIG. 1—item 4 also aids in rigidity of the complete lock box Operation of the 'Lock-Box' and Accessing the Apparatus For easy operation of the handle of the lock box for accessing or exiting a barrier fence restricted area FIG. 2 (e.g. A swimming pool enclosure) via the apparatus there are three 3 standing locations FIG. 2—x, y & z as follows:

i. For accessing the apparatus area from outside of the barrier fence restricted area—when the 'external' gate FIG. 2—item 10 is locked:
   position X—by standing on the outside of the apparatus and being outside of the barrier fence near the centre post FIG. 2—item 4.
ii. When traversing through the apparatus:
   position Y—by standing inside the apparatus directly in front of the lock box positioned on the centre post frame FIG. 2.
iii. For accessing the apparatus from the inside of the barrier fence restricted area—when the internal gate FIG. 2—9 is locked:
   position Z—by standing on the outside of the apparatus and being inside of the barrier fence near the centre post FIG. 2—item 4.

Figure 2:
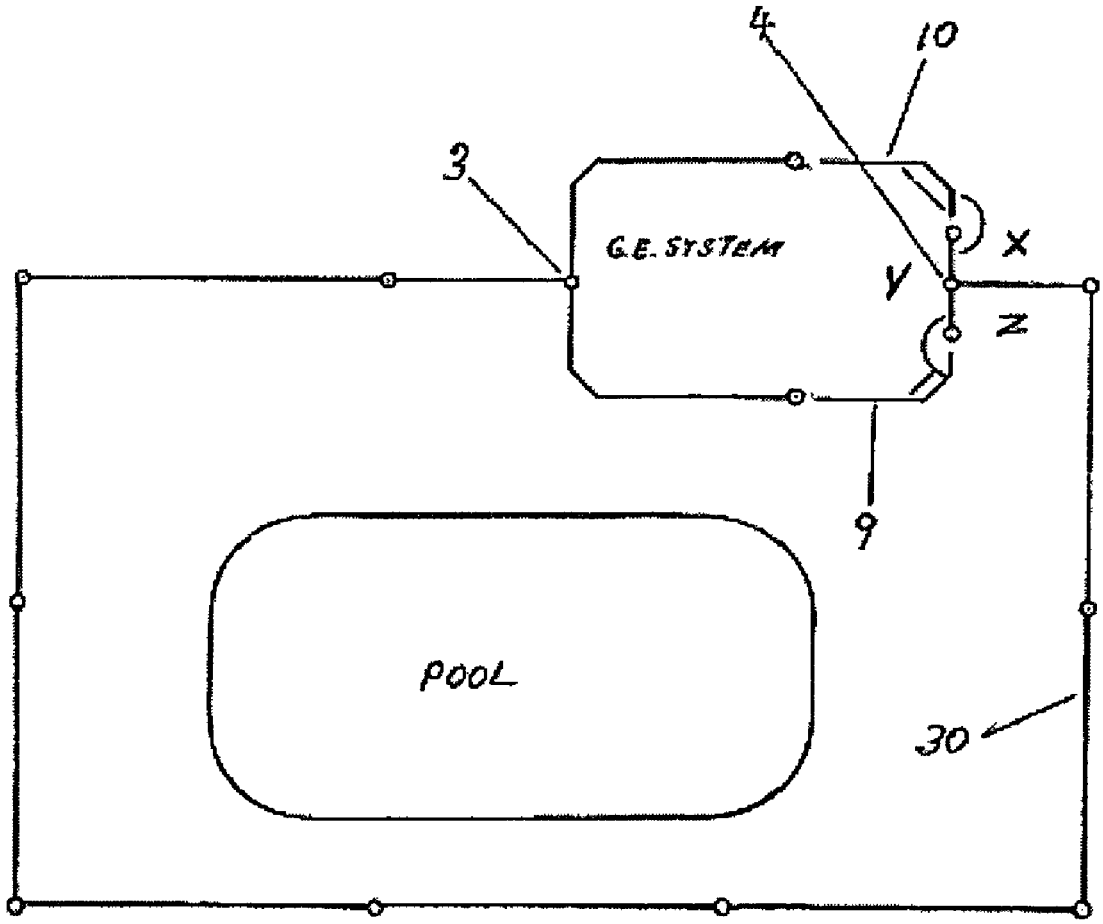
FIG. 2. Illustrates a schematic plan view of the gate assembly in a pool enclosure and forming part of the pool enclosure fencing.

The necessity of being able to access the lock box handle from each of these three 3 standing positions FIG. 2—x, y & z stems from the perspective that people will wish to enter or exit a barrier fence restricted area e.g. a swimming pool, at varying times. For instance, one or more people may wish to leave the swimming pool area FIG. 2 at a certain time, whilst leaving the remainder of the group behind. As this initial group leaves the barrier fence restricted area, the design of the apparatus means the internal gate FIG. 2—item 9 is the one now locked to the remaining people who will need to vacate in due course. It is logistically simple for them to operate the lock box handle from outside the apparatus i.e. at standing position FIG. 2—z so they may also exit the swimming pool enclosure.

The Lock-Box Specifications

The lock box FIG. 3 and FIG. 1—item 14 body is made up of two identical flat side wall plates FIG. 3—item 26*i* & *ii* which are approximately 220 mm in length, approximately 75 mm in height and approximately 4 mm thick, with holes drilled that secure it by bolts or fasteners to the sides of the top cross bar FIG. 1—item 19 of the centre post frame.

A slotted cut-out on either end of each side wall plate FIG. 3—item 25*a* & *b* allows the positioning and the arc movement of each semi-circular shaped locking plate FIG. 1—item 15 & 16. The lock box has a lid FIG. 3. item—27 which also has holes drilled into its sides. These lid sides fit between the two side wall plates FIG. 3. item—26*i* & *ii* where they are bolted or fastened securely between the two side wall plates. This lid FIG. 3. item —27 also has holes positioned in the top to facilitate connection by screws or fasteners of the extension section FIG. 4.—item 41 of the lock box which houses the stem of the operating handle alternatively the extension section may be welded to the lid in this position.

The sliding locking bar FIG. 3. item —24 is a straight sided rectangular section of steel approximately 160 mm long, approximately 40 mm wide and approximately 12 mm thick which, when fitted between the side wall plates FIG. 3. item—26*i* & *ii* slides easily due to small side wall clearances. On the top face of the sliding locking bar FIG. 3. item—24 at distances measured equally from the centre of the sliding locking bar, are two rigidly secured round locking pins FIG. 3. item—23*a* & *b*, being approximately 20 mm high and approximately 12 mm in diameter and which protrude upwards from the sliding locking bar.

In the middle or centre point of the sliding locking bar is a much longer, approximately 16 mm diameter round pin with a threaded end which is the stem FIG. 3. item—29. This stem FIG. 3. item—29 is also rigidly secured to the sliding locking bar FIG. 3. item—24 and it protrudes upwards through the slot FIG. 3. item—28 in the middle section of the lock box lid FIG. 3. item—27. This stem FIG. 3. item—29 and FIG. 4.—item 29 is positioned within the lock box extension section FIG. 4 item 41 and protrudes through a machined slot FIG. 4.—item 42.

When the operating handle FIG. 4—item 34 is attached to the top of this stem secured by a domed nut, it becomes the actuator part of the lock box assembly. A section of nylon 'lubron' type material FIG. 4—item 43 is positioned between the operating handle FIG. 4—item 34 and the top face of the extension section of the lock box FIG. 4—item 41 to act as a dust seal between the two sliding surfaces.

To enable easy horizontal slide movements of the sliding locking bar FIG. 3. item—24 a thin, flat section of nylon 'lubron' material or similar FIG. 3. item—35 being approximately the same length and width as the slide locking bar, is secured with countersunk screws to the top of the cross bar of the centre post frame FIG. 1 item 19. This 'lubron' type material FIG. 3. item—35 acts as a self-lubricating wear strip for the base of the sliding locking bar FIG. 3. item—24.

The Hinges for the Dual Gates

Figure 7:
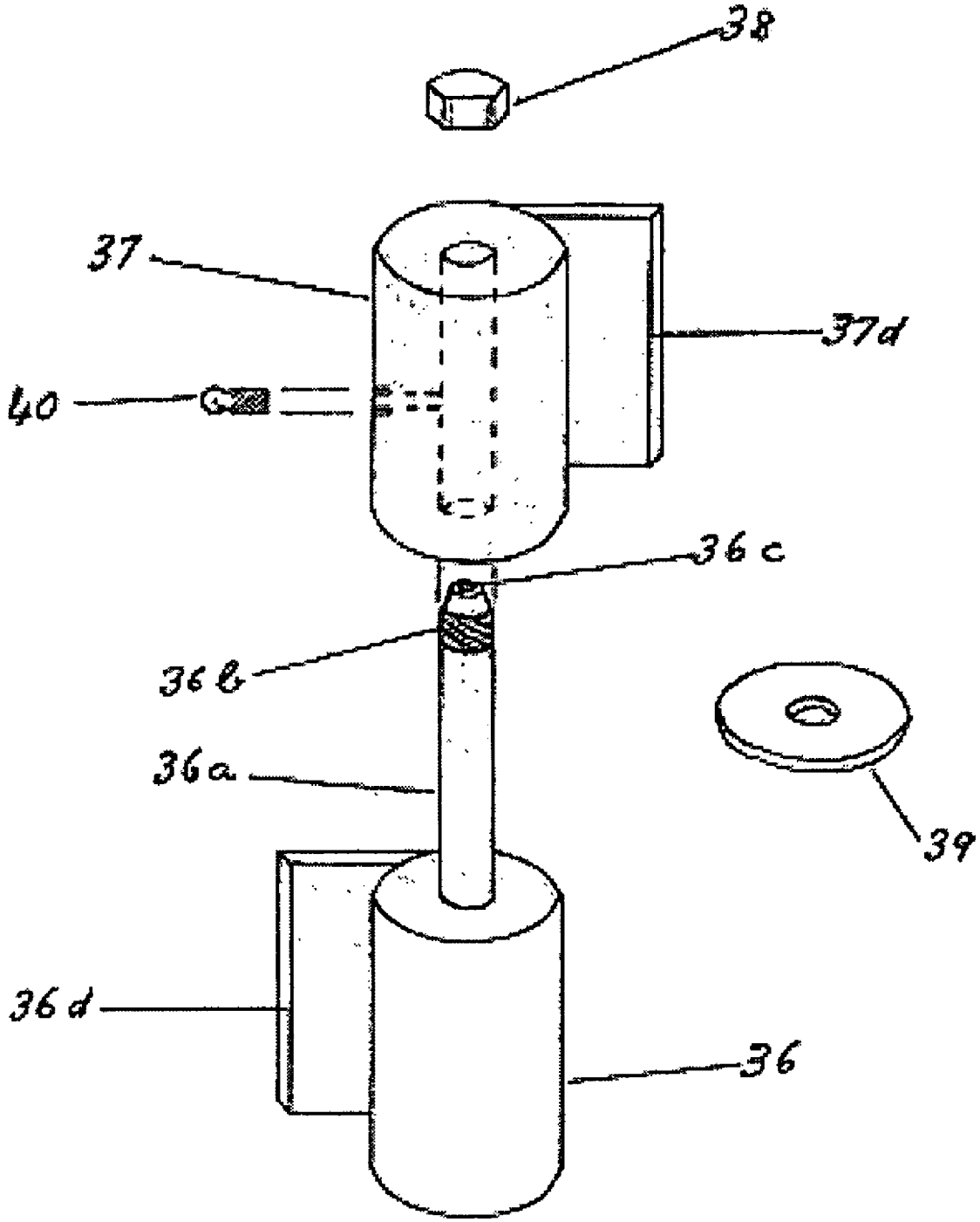
FIG. 7. Illustrate a hinge assembly according to a preferred embodiment.

The hinges FIG. 7 and FIG. 1—item 12 of which there are four being two for each gate and attached to the apparatus support posts FIG. 1 item 7 & 8, are designed for simplicity, rigidity and strength. The hinges FIG. 7 are manufactured from stainless steel and machined from round or hexagonal bar section. The base section FIG. 7—item 36 of the hinge has approximately half of its length machined to a small shaft FIG. 7—item 36*a* and sized to fit, allowing for small clearances, into a machined hole in a piece of similar material being the bush or top section FIG. 7—item 37 of the hinge. Near the end of this machined small shaft FIG. 7 item 36*a* section is a small thread FIG. 7—item 36*b* which has been cut to later accommodate a domed nut FIG. 7—item 38. Precisely in the centre of this shaft end is a small drilled centre drill hole FIG. 7—item 36*c* to be used as the central alignment during manufacture when securing each of the locking plates FIG. 1—item 15 & 16 on to the top rail of each gate FIG. 1—item 9 & 10.

Further, the base and top hinge sections FIG. 7—item 36 & 37 respectively, each have a thin gauge, rectangular stainless steel plate FIG. 7—item 36*d* & 37*d* respectively, welded to them to complete an anchoring arrangement on their respective uprights. The base hinge section plates FIG. 7—item 36*d* are fitted to the apparatus support posts FIG. 1—item 7 & 8 and the top hinge section plates FIG. 7—item 37*d* are fitted to the inner edge of the support upright of each gate structure FIG. 1—item 9*a* & 10*a*.

Between the two mating, machined faces of the hinges, i.e. the base section FIG. 7—item 36 and the top section FIG. 7—item 37, a small thin nylon 'lubron' or 'phosphor bronze' washer FIG. 7 item 39 of a calculated thickness can be positioned if necessary and may also be used as a gate height adjustment.

A grease nipple FIG. 7—item 40 may be fitted to the middle of the top hinge section of each hinge to facilitate lubrication to the pivot process of the hinge if necessary.

Explanation of the Locking Mechanism Sequences

FIG. 5*a*.

The position of the two locking plates 15 and 16 of the two gates 9 and 10 respectively, indicate that both of these two gates are in the closed position and as such, the cut outs 31*a* and 31*b* in the locking plates 15 and 16 respectively, are lined up horizontally. The round locking pin 23*a* on the sliding locking bar 24, has been totally removed from cut-out 31*a* in locking plate 15 of gate 9, by the horizontal movement using the sliding locking bar handle 34 which is located in the centre of the sliding locking bar 24. Consequently, for gate 10 the locking pin 23*b* is then fully positioned and firmly entrenched in cut-out 31*b* on the locking plate 16, and as such, gate 10 is securely closed and locked. Gate 9, however, in its position at this point in the locking sequence, is merely closed by the spring-loaded closing mechanism which is installed on each gate.

FIG. 5*b*.

Figure 5A:
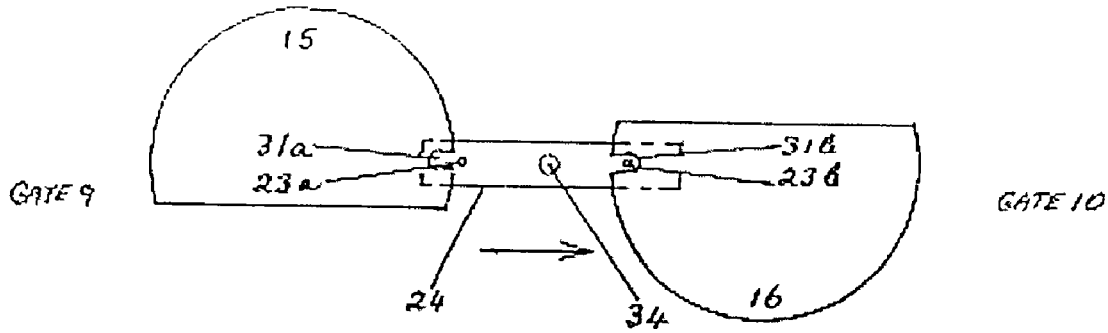
FIGS. 5*a-c* and FIGS. 6*a-b*. Illustrate operation of the latching mechanism.
Figure 6A:
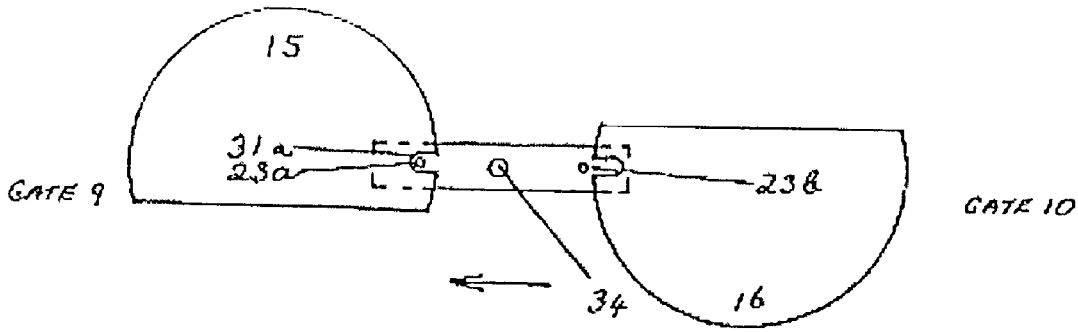
Figure 6B:
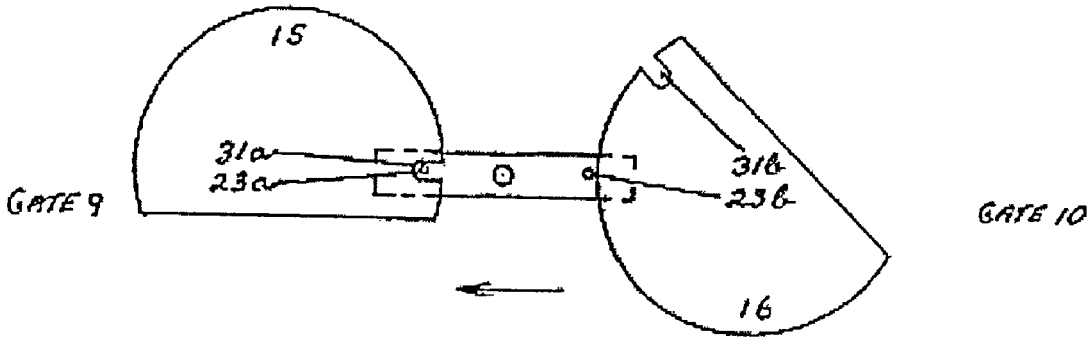

Gate 9 opens freely moving in from its position as shown in FIG. 5*a* because no restriction is present on the locking plate 15 as it moves round through its arc. Locking pin 23*a* cannot move back into the cut-out 31*a* because, as locking plate 15 moves around in its gate-opening arc, the cut-out 31*a* becomes out of alignment with the locking pin 23*a*. As well, locking pin 23*a* is prevented from further movement to the left-hand side by the outer edge 32 of the locking plate 15, i.e. the edge effectively creates a stopper for the locking pin. This restriction (being the edge of the locking plate) on the locking pin 23*a* which prevents movement of the locking bar 24 also ensures, in this sequence, that gate 10 is securely closed and locked and cannot be opened as the locking pin 23*b* is totally immovable, being now completely trapped in the cut-out 31*b*.

The result of this locking mechanism means that it is not feasible, in fact it is impossible, during this segment of the locking sequence, for gate 10 to move from the closed and locked position whilst gate 9 is open to any degree whatsoever. This is because both locking pins 23*a* and 23*b* are solidly secured on to the common sliding locking bar 24 and therefore always move simultaneously in the same direction.

FIG. 5*c*.

Gate 9 is now brought back to the closed position and the cut-out 31*a* is once again lined up horizontally with the locking pin 23*a*. Now, if the operating handle 34 of the locking bar 24 is moved in the direction to the left-hand side, i.e. from that shown in FIG. 5*b* to approximately the central point of the lock box, both locking pins 23*a* and 23*b* are then positioned just within the confines of each of the two cut-outs 31*a* and 31*b* at this point both gates 9 and 10 are effectively locked, and are always so locked as the operating handle 34 passes through this central point of the lock box. In reality, this means that both gates must be closed to allow both gates to be locked and from this central position the locking sequence can continue in either direction i.e. either to the left- or right-hand side, to open either one or the other of the two gates 9 and 10.

From this central locked position on the sliding locking bar 24, the operator can choose to move the operating handle 34 in either direction, thus choosing which gate is be released for opening and which gate will remain securely locked.

FIG. 6*a*.

When the operating handle 34 is now moved from the central position further across to the left-hand side of the lock box, the reverse situation to that shown in FIG. 5*a* has occurred, that is, the locking pin 23*a* is secured in the cut-out 31*a* in the locking plate 15 on gate 9 ensuring this gate is now securely closed and locked and as such leaves the locking plate 16 on gate 10 merely closed and in a position to be opened.

FIG. 6*b*

Figure 5B:
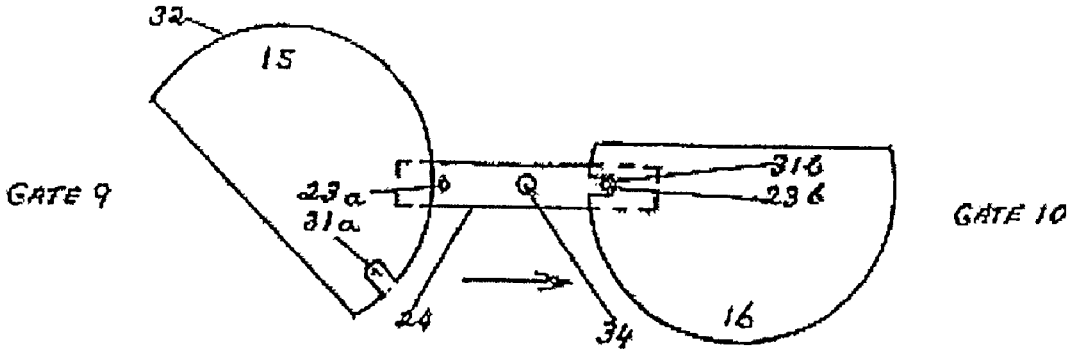
Figure 5C:
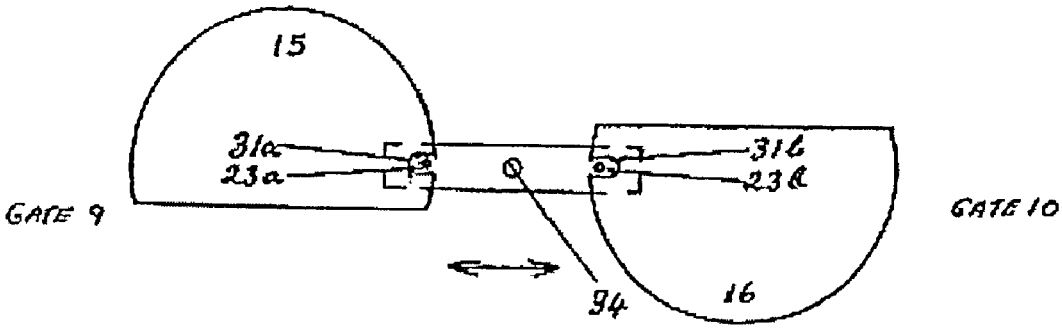

This locking sequence has the opposite effect to that as shown in FIG. 5*b*. Here the cut-out 31*b* in locking plate 16 has moved around in the arc as gate 10 is opened, and so cut-out 31*b* moves out of alignment with the locking pin 23*b*. Thus locking pin 23*b* is now effectively blocked from moving to the right by the edge of locking plate 16. Locking pin 23*a* is now trapped into the cut-out 31*a* ensuring gate 9 is now securely held in the closed and locked position.

Throughout the specification and the claims if present, unless the context requires otherwise, the term "comprise", or variations such as "comprises" or "comprising", will be understood to apply the inclusion of the stated integer or group of integers but not the exclusion of any other integer or group of integers.

Throughout the specification and claims if present, unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A gate assembly comprising a first gate, a second gate, an enclosure accessible by the first gate and the second gate, an upright member positioned generally between the first gate and the second gate, and a manual locking mechanism positioned on the upright member and which functions to latch and unlatch each gate, said locking mechanism including a latching member movable between a first position engaging a first cooperating locking device attached to the first gate for latching the first gate in a closed position and a second position engaging a second cooperating locking device attached to the second gate for latching the second gate in a closed position, and wherein the second cooperating locking device is released from the latching member when the latching member is in the first position to allow the second gate to open, the first cooperating locking device is released from the latching member when the latching member is in the second position to allow the first gate to open, the first cooperating locking device prevents movement of the latching member out of the second position when the first gate is not in the closed position thereof, and the second cooperating locking device prevents movement of the latching member out of the first position when the second gate is not in the closed position thereof, whereby unlatching of the first gate causes the second gate to remain latched, and the second gate cannot be unlatched until the first gate is latched, and vice versa.

2. The assembly as claimed in claim 1, wherein the enclosure has an internal area of between 1-5 square meters.

3. The assembly as claimed in claim 1, wherein the upright member includes a centre post frame which has two vertical edges on opposite sides thereof, and wherein the first gate is hingedly attached to one of the vertical edges, and the second gate is hingedly attached to the other vertical edge.

4. The assembly as claimed in claim 3, wherein the centre post frame comprises a central support post and side support posts on opposite sides of the central support post.

5. The assembly as claimed in claim 4, wherein at least one of the gates is hingedly attached to a respective one of the side support posts.

6. The assembly as claimed in claim 1, wherein one of the gates is mounted to the centre post frame to open inwardly into the enclosure and the other gate is mounted to the centre post frame to open outwardly from the enclosure.

7. The assembly as claimed in claim 6, wherein each gate is configured to be a self-closing gate.

8. The assembly as claimed in claim 1, wherein the first and second cooperating locking devices each include a respective locking plate attached to the respective gate such that swinging of the respective gate causes rotation of the locking plate.

9. The assembly as claimed in claim 8, wherein the latching member includes a sliding locking bar.

10. The assembly as claimed in claim 9, wherein each locking plate is provided with a recess, and the sliding locking bar can slide into the recess to prevent rotation of the respective locking plate and therefore to prevent opening of the respective gate.

11. The assembly as claimed in claim 10, including a locking box which contains a recess, the locking plate being adapted to pass into the recess of the locking box at all times.

12. The assembly as claimed in claim 10, wherein each locking plate has an arcuate portion that operates, during opening movement of the respective gate, to hold the locking bar engaged in the recess of the locking plate attached to the other gate, thereby to prevent opening of the other gate.

* * * * *